US009435180B2

(12) United States Patent
Casciaro et al.

(10) Patent No.: US 9,435,180 B2
(45) Date of Patent: Sep. 6, 2016

(54) ANNULAR GAS LIFT VALVE

(71) Applicant: BAKER HUGHES INCORPORATED, Houston, TX (US)

(72) Inventors: Dario Casciaro, Pescara (IT); Steven Johnstone, Aberdeenshire (GB)

(73) Assignee: BAKER HUGHES INCORPORATED, Houston, TX (US)

( * ) Notice: Subject to any disclaimer, the term of this patent is extended or adjusted under 35 U.S.C. 154(b) by 393 days.

(21) Appl. No.: 14/062,292

(22) Filed: Oct. 24, 2013

(65) Prior Publication Data

US 2015/0114663 A1 Apr. 30, 2015

(51) Int. Cl.

| | |
|---|---|
| ***E21B 34/10*** | (2006.01) |
| ***F04B 47/04*** | (2006.01) |
| ***F04F 1/08*** | (2006.01) |
| ***E21B 43/12*** | (2006.01) |
| ***E21B 17/00*** | (2006.01) |
| ***E21B 34/08*** | (2006.01) |

(52) U.S. Cl.
CPC ..... *E21B 43/123* (2013.01); *E21B 17/00* (2013.01); *E21B 34/08* (2013.01); *E21B 43/122* (2013.01)

(58) Field of Classification Search
CPC combination set(s) only.
See application file for complete search history.

(56) References Cited

U.S. PATENT DOCUMENTS

| | | | | |
|---|---|---|---|---|
| 122,950 | A * | 1/1872 | Lytle | F04F 1/06 417/131 |
| 1,596,303 | A * | 8/1926 | Redfield | F04F 1/06 417/143 |
| 3,642,070 | A * | 2/1972 | Taylor | E21B 34/105 166/297 |
| 5,535,828 | A | 7/1996 | Der Kinderen et al. | |
| 5,937,945 | A | 8/1999 | Bussear et al. | |
| 6,070,608 | A | 6/2000 | Pringle | |
| 6,691,787 | B2 | 2/2004 | Amani | |
| 7,228,909 | B2 | 6/2007 | Schmidt et al. | |
| 8,225,874 | B2 | 7/2012 | Messick et al. | |
| 2003/0164240 | A1 | 9/2003 | Vinegar et al. | |
| 2007/0181312 | A1 | 8/2007 | Kritzler et al. | |
| 2010/0096142 | A1 | 4/2010 | Randazzo | |
| 2010/0108326 | A1 | 5/2010 | Messick et al. | |
| 2011/0042097 | A1 | 2/2011 | Stephenson et al. | |
| 2012/0152552 | A1 | 6/2012 | Mitchell et al. | |
| 2012/0312554 | A1 | 12/2012 | Nguyen et al. | |
| 2013/0025845 | A1 | 1/2013 | Kleppa et al. | |

OTHER PUBLICATIONS

PCT/US2014/060932—International Search Report dated Jan. 12, 2015.

* cited by examiner

*Primary Examiner* — Giovanna C Wright
*Assistant Examiner* — Ronald Runyan
(74) *Attorney, Agent, or Firm* — Mossman, Kumar & Tyler PC

(57) ABSTRACT

A system for producing hydrocarbons may include a production control device positioned along a production flow line. The production control device may include an enclosure having an interior space and an isolation device disposed in the interior space. The isolation device may divide the interior space into an upper interior space and a lower interior space. The production control device may also include a first flow control device positioned in the upper interior space, and a second flow control device positioned in the upper interior space. The first flow control device may be responsive to a control signal transmitted via a control line from a surface location. The second flow control device may reactively block fluid flow from the lower interior section to the upper interior section when a pressure differential between the upper interior space and the lower interior space falls below a preset value.

14 Claims, 2 Drawing Sheets

ANNULAR GAS LIFT VALVE

BACKGROUND OF THE DISCLOSURE

1. Field of the Disclosure

The disclosure herein relates generally to the methods and devices for artificial gas lift operations in hydrocarbon producing wells.

2. Background of the Art

Hydrocarbon production systems typically rely on formation pressure from subterranean reservoirs to produce hydrocarbon fluids and gases. In a naturally flowing well, there is enough energy stored in the high pressure reservoir to produce liquids and gases to the surface. When this reservoir energy decreases, it is generally necessary to apply some form of artificial lift to assist in producing these liquids and gases to the surface.

Gas lift is a form of artificial lift that is used to assist in producing boreholes that do not flow or cannot flow at optimum or desired producing rates. Gas lift systems generally include a mechanism for injecting high pressure gas from an annular region of the well into a production conduit. Conventionally, a valve actuated by using control lines is used in gas lift systems to control flow of the high pressure gas into the production conduit.

The present disclosure is directed to methods, devices, and system for gas lift arrangements that do not use control lines for actuating such valves.

SUMMARY OF THE DISCLOSURE

In aspects, the present disclosure provides a system for producing hydrocarbons from a well having a borehole. The system may include a production flow line disposed in the borehole and a production control device positioned along the production flow line. The production control device may include an enclosure having an interior space, an isolation device disposed in the interior space, the isolation device dividing the interior space into an upper interior space and a lower interior space, a first flow control device positioned in the upper interior space and controlling flow along the production flow line, and a second flow control device positioned in the upper interior space and controlling fluid flow between the upper interior space and the lower interior space. The first flow control device may be responsive to a control signal transmitted via a control line from a surface location. The second flow control device may reactively block fluid flow from the lower interior section to the upper interior section when a pressure differential between the upper interior space and the lower interior space falls below a preset value.

In aspects, the present disclosure provides a method for producing hydrocarbons from a well having a borehole. The method may include disposing a production flow line in the borehole; positioning a production control device along the production flow line, the production control device including an enclosure having an interior space, an isolation device disposed in the interior space, the isolation device dividing the interior space into an upper interior space and a lower interior space; controlling flow along the production flow line using a first flow control device positioned in the upper interior space, the first flow control device being responsive to a control signal transmitted via a control line from a surface location, and controlling fluid flow between the upper interior space and the lower interior space using a second flow control device positioned in the upper interior space, the second flow control device reactively blocking fluid flow from the lower interior section to the upper interior section when a pressure differential between the upper interior space and the lower interior space falls below a preset value.

Examples certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

In aspects, there is provided apparatuses and methods for controlling hydrocarbon production in a borehole in an earth formation. A production assembly such as a production string is configured to be disposed in a borehole and facilitate production of hydrocarbons (e.g., oil and/or gas). A flow control device associated with the production assembly selectively allows pressurized gas to flow into the production assembly to provide lift and facilitate hydrocarbon production. As discussed below, the flow control devices according to the present disclosure may be configured to react to changes in pressure differentials and therefore open and close without using control lines from the surface.

Figure 1:
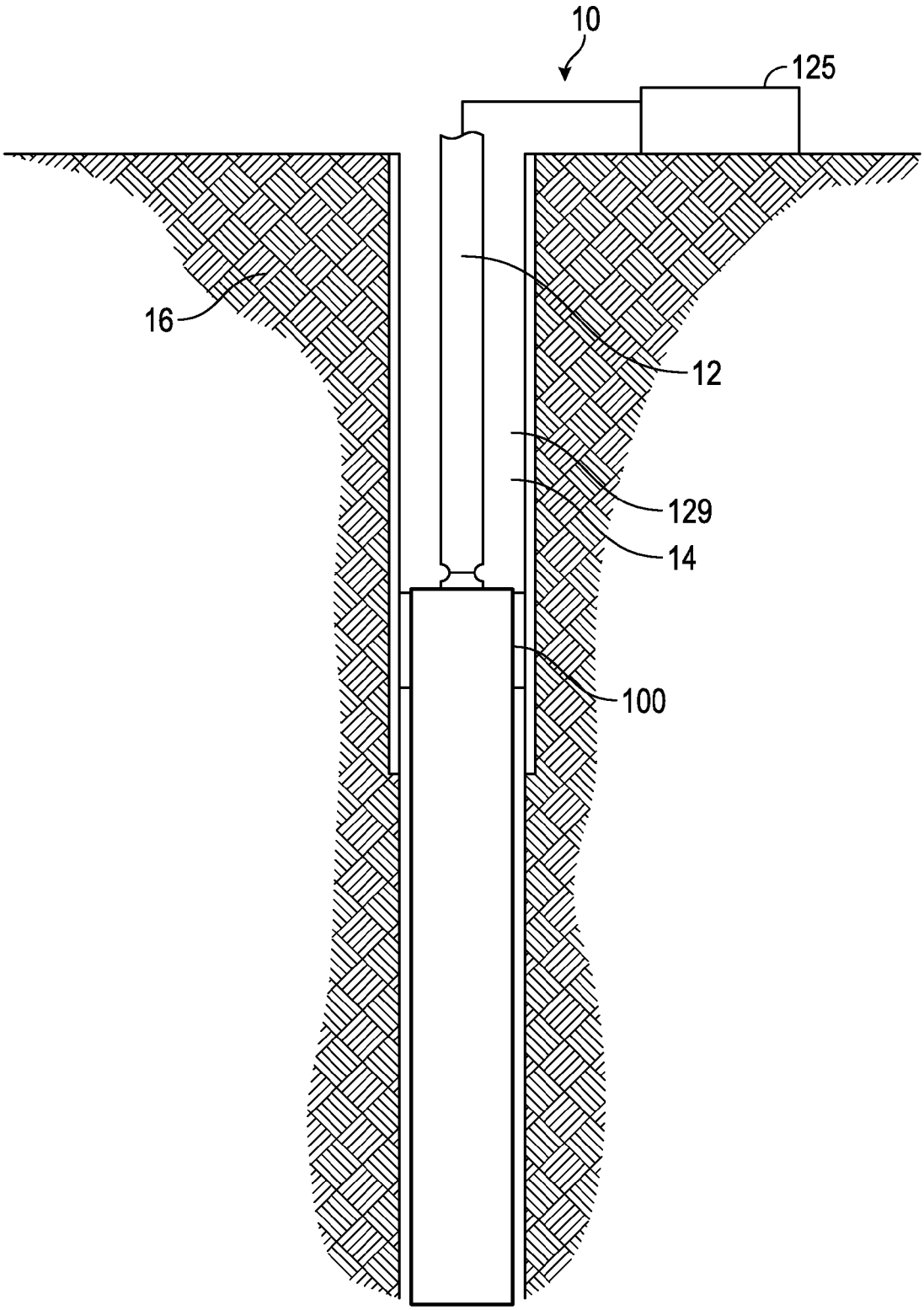
FIG. 1 depicts an embodiment of a downhole completion and/or production system including a flow control device.

Referring to FIG. 1, an exemplary production well 10 includes a borehole string 12 that is shown disposed in a borehole 14 that penetrates at least one earth formation 16. The borehole 14 may be an open hole or an at least partially cased hole, and may be generally vertical or include a horizontal component. A "borehole string", as used herein, refers to a production flow line having a production string, and may also refer to any structure or carrier suitable for lowering a tool or component through a borehole and/or connecting a tool to the surface, and is not limited to the structure and configuration described herein. Exemplary non-limiting carriers include borehole strings of the coiled tube type, of the jointed pipe type and any combination or portion thereof. The well 10 may be located on shore or off shore. In one arrangement, the well 10 may include a production control system 100 positioned along the borehole string 12. The production control system 100 introduces a pressurized gas into the fluid produced by the formation 16 to improve production rates. The pressurized gas may be supplied from a control facility 125, which may include known devices such as pumps, gas containers, control electronics for operating downhole tools using control signals, and flow lines (not shown). The pressurized gas flows down a wellbore annulus 119 to the production control system 100. Thus, there are two parallel and independent flow paths in the borehole 12: the bore of the borehole string 12, which typically conveys produced fluids, and the annulus 119 that surrounds the borehole string 12, which can convey pressurized gas downhole.

Figure 2:
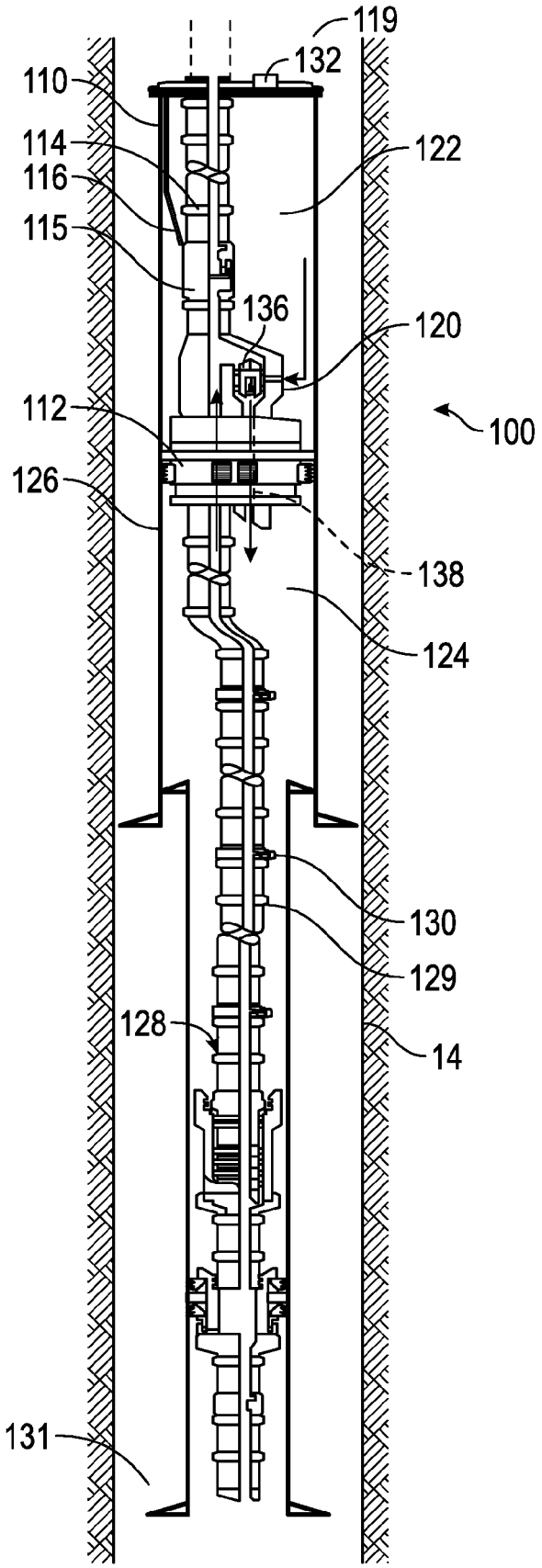
FIG. 2 is a schematic elevation view of an exemplary embodiment of a flow control device according to the present disclosure.

Referring to FIG. 2, there is shown in greater detail one embodiment of a production control system 100 in accordance with the present disclosure. The production control system 100 may include an enclosure 110, an isolation device 112, a production flow line 114, and a flow control device 120. The enclosure 110 may be a sealed hanger or housing within which a lifting gas may be injected into a produced fluid. The isolation device 112, which may be a production packer, may be used to hydraulically isolate an upper interior space 122 from a lower interior space 124 in the enclosure 110. As used herein, reference to the upper interior space 122 or the lower interior space 124 is a reference only to the volume external to the production flow line 114.

The production flow line 114 may include a flow control device such as a safety valve 115 that is actuated between an open and a closed position along the production flow line 114. By "closed," it is meant the flow control device 115 blocks fluid flow across the production string 114. The control line 116 penetrates the enclosure 110 and leads to the control facility 125 (FIG. 1) at the surface. The control line 116 may communicate pressurized hydraulic fluid and/or electrical power. The production flow line 114 also includes a tubular section 128 positioned in the lower interior space 124. The tubular section 120 may include one or more mandrels 129. Each mandrel may have one or more injection inlets 130 that selectively admit gas from the lower interior space 124 into the mandrel 129. By selectively, it is meant gas is injected into the mandrel 129 if and when one or more operating parameters (e.g., a minimum gas pressure) are satisfied.

The flow control device 120 reactively controls the flow of gas between the upper interior space 122 and the lower interior space 124 of the enclosure 110. The flow control device 120 may include a valve 136 configured to admit the gas from the upper interior space 122 into a conduit 138 in the isolation device 132. The conduit 138, which is shown in hidden lines, allows fluid communication between the upper and lower interior spaces 122, 124.

The flow control device 120 reactively controls fluid flow because the valve 136 is responsive to a pre-determined pressure differential value between the upper interior space 122 and the lower interior space 124. For example, the valve 136 may be configured to open when the pressure in the upper interior space 122 is greater than the pressure in the lower interior space 124, or a "positive" pressure differential, which indicates a fluid flow in the downhole direction. The valve 136 responsively closes if and when the positive pressure differential is below the preset threshold value. The valve 136 may be any uni-directional flow control device. For example, the valve 136 may be a reverse flow check valve that prevents pressurized gases from flowing from the lower interior space 124 to the upper interior space 122. It should be appreciated that the valve 136 may be opened and closed by controlling a flow parameter of the gas being pumped into the well annulus 119. That is, controlling the pressure or flow rate of the gas being pumped into the well annulus 119 controls operation of the valve 136. Thus, separate control lines are not needed to actuate the valve 136. By "open," it is meant the flow control device 120 allows fluid flow across the conduit 138. By "closed," it is meant the flow control device 120 blocks fluid flow across the conduit 138. By "reactively," it is meant that the valve actuates to the closed position autonomously and without a signal transmitted from the surface; e.g., a hydraulic signal sent from the surface via a control line connected to the second flow control device.

In one mode of operation, the surface facility 125 pumps a lifting gas into the annulus 119. The gas flows down the borehole 12 and enters the upper interior space 122. As long as the preset threshold positive pressure differential value is exceed between the upper interior space 122 and the lower interior space 124, the valve 136 remains in an open position and allows fluid communication in the downhole direction. As the gas fills the lower interior space 124, the resident liquids are displaced such that the injection inlets 130 are successively exposed. Typically, liquids are displaced until the liquid line is below the lowest injection inlet 130. Now, gas flows into the mandrels 129 via the injection inlet 130 mixes with the formation liquids in the mandrels 129. The addition of the gas reduces the density of the formation liquids and allows these liquids to flow via the production flow line 114 to the surface.

Either intentionally or unintentionally, the pressure differential at the isolation device 112 may drop below the threshold positive pressure differential value. In such an instance, the valve 136 reacts to the drop in the pressure differential and closes to block fluid flow from the lower interior space 124 to the upper interior space 122 via the conduit 138. For example, surface operators may deliberately reduce the pressure of the gas being pumped into the well annulus 119 in order to close the valve 136. It should be appreciated that the valve 136 is closed without using a communication signal from the surface via a separate control line. An unplanned closing of the valve 136 may occur if the borehole has encountered a fluid influx (e.g., a gas kick) or some other event that causes an increase in wellbore pressure in the lower interior space 124 or at a wellbore bottom 131. Such a pressure increase may lower the positive pressure differential below the threshold value and cause the valve 136 to automatically or reactively close. In such an instance, a well operator can use the control line 116 to transmit the control signal that causes the production valve 115 to close. Thus, when both flow control devices, valves 115, 136, are closed, the fluids in the borehole below the production packer 112 have been isolated and cannot flow to the surface.

The production control device 100, and the components making up the production control device 100, including the flow control device 120, may be retrieved from the borehole using a conveyance device such as a wireline, slickline, or other suitable non-rigid carrier. These components may include a suitable "fishing neck" or other similar retrieval mechanism to facilitate removal. Thus, when desired, a wireline (other suitable conveyance device) may be secured to a component (e.g., the flow control device 120) or the production control device 100, for extraction from the well.

As used here, the terms "above" and "below"; "up" and "down"; "upper" and "lower"; "upwardly", "downwardly"; "up hole" and "down hole" and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. A system for producing hydrocarbons from a well having a borehole, comprising:

a production flow line disposed in the borehole; and a production control device positioned along the production flow line, the production control device including:

an enclosure having an interior space, an isolation device disposed in the interior space, the isolation device dividing the interior space into an upper interior space and a lower interior space, a first flow control device positioned in the upper interior space and controlling flow along the production flow line, the first flow control device being responsive to a control signal transmitted via a control line from a surface location, and a second flow control device positioned in the upper interior space and controlling fluid flow between the upper interior space and the lower interior space, the second flow control device reactively blocking fluid flow from the lower interior section to the upper interior section when a pressure differential between the upper interior space and the lower interior space falls below a preset value, wherein the second flow control device is configured to move to an open position to allow fluid flow between the upper interior space and the lower interior space by increasing a gas pressure in the upper interior space.

2. The system of claim 1, wherein the production flow line includes a tubular section disposed in the lower interior space, and wherein the tubular section includes an inlet selectively admitting a gas into the tubular section.

3. The system of claim 1, wherein the enclosure includes a port admitting a gas from an annulus surrounding the production tubular into the upper interior space.

4. The system of claim 3, wherein the isolation device includes a conduit providing gas communication between the second flow control device and the lower interior space.

5. The system of claim 1, wherein the lower interior space is isolated from the upper interior space when the first flow control device and the second flow control device are in the closed position.

6. The system of claim 1, further comprising a control facility at a surface location supplying a gas into an annular space surrounding the production flow line.

7. The system of claim 1 wherein the second flow control device autonomously blocks fluid flow from the lower interior section to the upper interior section without using a hydraulic signal transmitted from the surface via a control line connected to the second flow control device.

8. A method for producing hydrocarbons from a well having a borehole, comprising:

disposing a production flow line in the borehole;

positioning a production control device along the production flow line, the production control device including an enclosure having an interior space, an isolation device disposed in the interior space, the isolation device dividing the interior space into an upper interior space and a lower interior space;

controlling flow along the production flow line using a first flow control device positioned in the upper interior space, the first flow control device being responsive to a control signal transmitted via a control line from a surface location, controlling fluid flow between the upper interior space and the lower interior space using a second flow control device positioned in the upper interior space, the second flow control device reactively blocking fluid flow from the lower interior section to the upper interior section when a pressure differential between the upper interior space and the lower interior space falls below a preset value; and moving the second flow control device to an open position to allow fluid flow between the upper interior space and the lower interior space by increasing a gas pressure in the upper interior space.

9. The method of claim 8, wherein the production flow line includes a tubular section disposed in the lower interior space, and wherein the tubular section includes an inlet, and further comprising selectively admitting a gas into the tubular section.

10. The method of claim 8, wherein the enclosure includes a port, and further comprising admitting a gas from an annulus surrounding the production tubular into the upper interior space.

11. The method of claim 8, wherein the isolation device includes a conduit providing gas communication between the second flow control device and the lower interior space.

12. The method of claim 8, wherein the lower interior space is isolated from the upper interior space when the first flow control device and the second flow control device are in the closed position.

13. The method of claim 8, further comprising supplying a gas into an annular space surrounding the production flow line, the gas being supplied from a control facility at a surface location.

14. The method of claim 8, wherein the second flow control device autonomously blocks fluid flow from the lower interior section to the upper interior section without using a hydraulic signal transmitted from the surface via a control line connected to the second flow control device.

* * * * *